US006768473B2

(12) United States Patent
Harland et al.

(10) Patent No.: US 6,768,473 B2
(45) Date of Patent: Jul. 27, 2004

(54) ANTENNA SYSTEM AND METHOD

(75) Inventors: Michael W. Harland, Quincy, IL (US); William A. Kerkhoff, Quincy, IL (US); Rex L. Niekamp, Quincy, IL (US); Eric L. Power, Quincy, IL (US); David W. Rees, Camp Point, IL (US); Jeffrey H. Steinkamp, Quincy, IL (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/194,284

(22) Filed: Jul. 15, 2002

(65) Prior Publication Data

US 2004/0008150 A1 Jan. 15, 2004

(51) Int. Cl.[7] ..... H01Q 1/12

(52) U.S. Cl. ..... 343/890; 343/797; 343/814; 343/878

(58) Field of Search ..... 343/793, 797, 343/799, 810, 812, 814, 878, 891, 892, 893, 844, 890

(56) References Cited

U.S. PATENT DOCUMENTS 4,446,465 A * 5/1984 Donovan ..... 343/797
5,237,336 A * 8/1993 Jelloul ..... 343/799
5,534,882 A * 7/1996 Lopez ..... 343/891
6,067,053 A * 5/2000 Runyon et al. ..... 343/797
6,300,915 B1 * 10/2001 Lopez ..... 343/813
6,380,909 B1 * 4/2002 Wilkinson et al. ..... 343/890

OTHER PUBLICATIONS

G. W. Collins, *Fundamentals of Digital Television*, New York: John Wiley & Sons, 2001 pp. 197–198.

J.D. Kraus, *Antennas 2nd ed.*, New York: McGraw Hill, 1988, pp. 735–744.

Johnson and Jasik, ed., *Antenna Engineering Handbook 2nd* ed., New York: McGraw Hill, 1984, pp. 28–11.

Thomas Vaughan, "Antennas For Television Broadcast," *National Association of Broadcasters Engineering Handbook*, Seventh Edition, p. 194.

Peter K. Onnigian and Eric Dye, "Antennas For FM Broadcasting", *National Association of Broadcasters Engineering Handbook*, Eighth Edition, p. 290.

* cited by examiner

*Primary Examiner*—Shih-Chao Chen
(74) *Attorney, Agent, or Firm*—Baker & Hostetler LLP

(57) ABSTRACT

An antenna is provided that includes a mast, a first dipole, and a second dipole. The first dipole crosses with the second dipole, and the first dipole and the second dipole form a first antenna assembly that is coupled to the mast. A hybrid power divider is coupled to the first antenna assembly, and an internal feed system, positioned within the mast, is coupled to the hybrid power divider. The antenna may include a rigid coaxial internal and external feed system.

22 Claims, 3 Drawing Sheets

ANTENNA SYSTEM AND METHOD

FIELD OF THE INVENTION

The present invention relates generally to an antenna system. More particularly, the present invention is directed to a multi-channel, circularly polarized antenna that is suitable for high power broadband multiplexing.

BACKGROUND OF THE INVENTION

Under the rules of the Federal Communication Commission (FCC), television (TV) broadcasters are required to complete a transition from their current National Television System Committee antenna systems to digital television (DTV) antenna systems by the year 2006. To fulfill the requirements of the FCC, TV broadcasters are installing DTV antenna systems on their existing antenna towers.

Historically, radio frequency (RF) station operators including, for example, frequency modulation (FM) radio station operators, lease tower space from TV stations to accommodate their FM antennas. However, TV station operators, in their attempts to go on-air with DTV, are finding that the addition of DTV antennas to their antenna towers limits the amount of tower space available to accommodate the antennas of the FM radio station operators.

The addition of the DTV antennas to the existing antenna towers has not only reduced the amount of space available for leasing out, but has also driven up both the weight loads and windloads of those existing antenna towers. The number of antennas that can be installed on an antenna tower is limited to the amount of tower space, the amount of weight the tower can withstand and/or the amount of windload the tower can withstand. Accordingly, a tower can only withstand a certain amount of weight and/or windload before the tower fails in its support functions.

Constucting new towers is sometimes not a feasible solution. Aside from the high cost of tower construction, difficulties arise in finding an acceptable location and in obtaining construction permits. Community members near the proposed construction site may oppose the building of antenna towers in their communities. In addition, tower construction may be limited to locations where the environmental conditions are suitable for the erection of an antenna tower. For example, it may sometimes not be suitable to bulid antenna towers where the moisture level in the soil is high.

To alleviate overcrowding and potentially overloading antenna towers, radio station operators have turned to sharing multi-channel antennas. Multi-channel antennas are capable of transmitting more than one station, and thus, it is possible to avoid having an antenna for every FM station.

However, there are disadvantages of utilizing conventional multi-channel FM antennas, such as circularly-polarized FM muliplex dipole antennas and circularly-polarized broadband panel antenna arrays. For example, a conventional circularly-polarized FM multiplex dipole antenna is typically a sidemount antenna. When signals are transmitted from sidemount antennas, the signals tend to reflect off of the legs of the antenna tower and inhibit the FM antenna from generating a circularly-polarized/omnidiretional azimuth pattern. Consequently, the signal coverage is reduced. In addition, the amount of reflection is typically attributed to the frequency of the signals being transmitted. Often, the greater the frequency, the greater the amount of reflection, and the greater the effects on the azimuth pattern.

FM multiplex antennas should be designed to transmit signals of varying frequencies. Thus, there is difficulty in designing the conventional circularly-polarzied FM multiplex dipole antenna to generate a consistent azimuth pattern across the full FM band because the azimuth pattern varies with frequency. Accordingly, it is difficult to provide consistent signal coverage across the full FM band. In addition, the conventional circularly-polarized FM antenna requires that the signals, which will be multiplexed, are within a few mega hertz (MHz) of each other.

Conventional circularly-polarized broadband panel antenna arrays also present problems. For example, broadband panel antenna arrays include three antenna panels, where each panel is designed, such that its width is the same as the width of a face of an antenna tower, which is often between six feet (1.829 meters) and ten feet (3.048 meters). Each panel of the array is placed on a face of an antenna tower. Accordingly, a broadband panel antenna array requires a substantial amount of tower space. In addition, because of the relatively large surface area of a broadband panel, it is capable of being subjected to high windloads.

Further, broadband panel arrays are typically accompanied by complex feed systems that employ semi-flexible coaxial feed lines. The semi-flexible coaxial lines, if inadequately or improperly installed, can become disfigured and cause operational problems.

Accordingly, it would be desirable to provide a reliable circularly-polarized broadband antenna that provides for multi-channel transmission across the full FM band. Additionally, it would be desirable to provide a circularly-polarized broadband antenna that is characterized by low windloads, can provide a compact tower space and/or generates a satisfactorily consistent omnidirectional azimuth pattern.

SUMMARY OF THE INVENTION

In one aspect of the present invention, an antenna is provided that includes a mast, a first dipole, and a second dipole, wherein the first dipole crosses with the second dipole, and wherein the first dipole and the second dipole form a first antenna assembly that is coupled to the mast. A hybrid power divider is coupled to the first antenna assembly, and an internal feed system, positioned within the mast, is coupled to the hybrid power divider.

In another aspect of the present invention, an antenna is provided that includes a mast, a first dipole half and a second dipole half that form a first dipole, and a third dipole half and a fourth dipole half that form a second dipole. The first and second dipoles form a first antenna assembly. An internal feed system positioned within the mast, and a means for feeding the first antenna assembly is coupled to the internal feed system and the first antenna assembly.

In yet another aspect of the present invention, a method for transmitting a circularly-polarized signal is provided that includes inputting signal power into a main power divider, transmitting the signal power from the main power divider to main output lines positioned within a mast, transmitting the signal power from the main output lines to a three-way power divider positioned within the mast, transmitting the signal power from the three-way power divider to a two-way power divider positioned external to the mast, transmitting the signal power from the two-way power divider to a hybrid power divider, and transmitting the signal power from the hybrid power divider to crossed dipoles.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENTS OF THE INVENTION

Although the invention will be described specifically with regards to FM radio signal broadcasting, the invention has broader application to signal broadcasting in general, and could be utilized to transmit for example, any RF signal, DTV signal and/or digital radio signal, either separately or multiplexed together.

Figure 1:
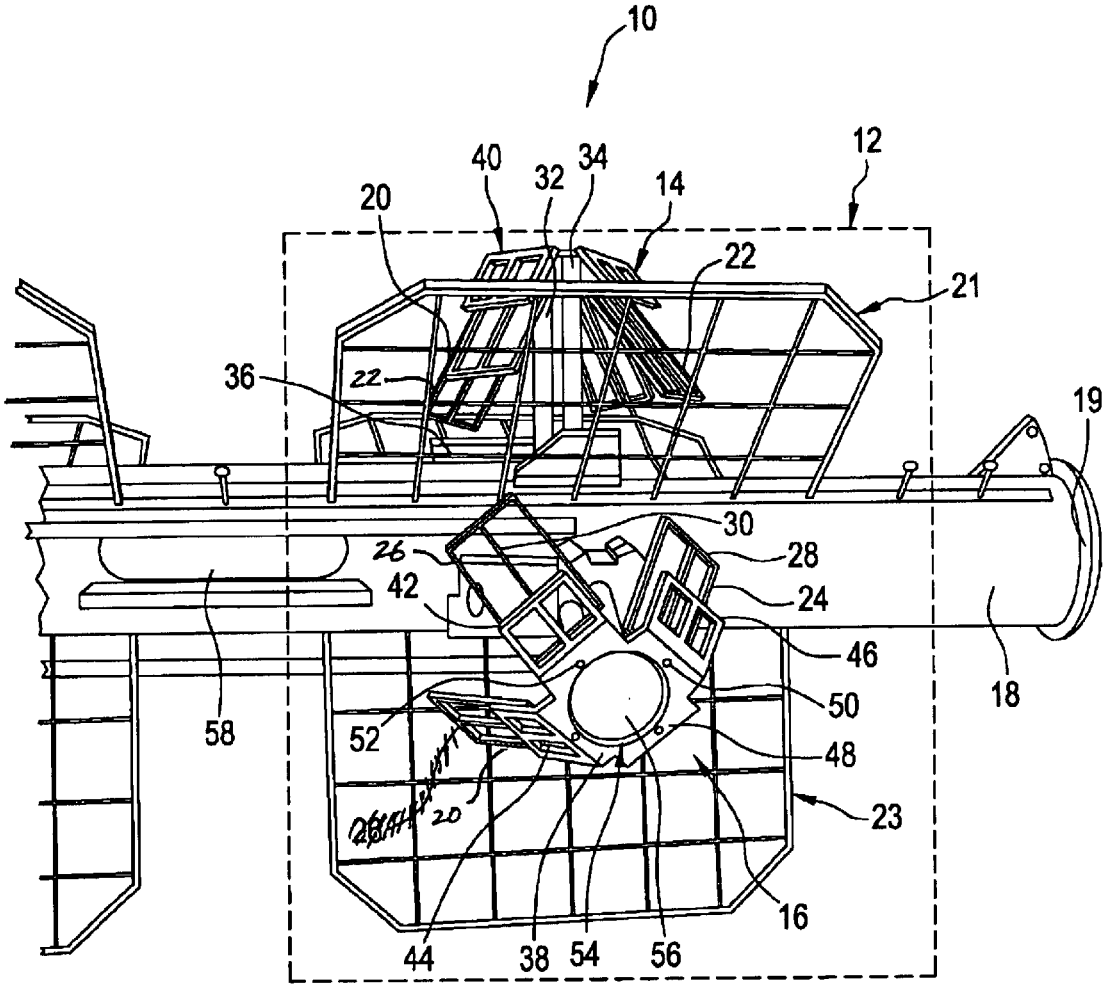
FIG. 1 is a front perspective view of one bay of an antenna in accordance with the present invention.

Referring now to the figures, wherein like reference numerals indicate like elements, there is illustrated a circularly-polarized antenna 10, in accordance with a preferred embodiment of the present invention, having a plurality of antenna bays 12. Each antenna bay 12 includes three circularly polarized antenna assemblies 14, 16, (only two of which are shown in FIG. 1). Each antenna assembly 14, 16 is spatially disposed around the circumference of a mast 18. The antenna assemblies 14, 16 are equally spaced about the circumference of the mast 18. An antenna 10, in accordance with the present invention, has a plurality of antenna bays 12 that are stacked about a vertical axis of the mast 18. The mast 18 has a flange 19 that provides convenient and flexible mounting to existing antennas and/or towers.

In an exemplary embodiment of the present invention, each antenna assembly 14, 16 can be configured as a modular unit independent of the antenna 10. Each antenna assembly includes four of the radiating elements 20, 22, 24, 26 or dipole halves (element 22 being visible in antenna assembly 14 while being obstructed from view in antenna assembly 16). Each pair of opposing radiating elements (e.g., 20 with 24 and 22 with 26) form a crossed dipole. Accordingly, each antenna assembly 14, 16 includes a pair of dipoles that are crossed.

In the same or another exemplary embodiment of the present invention, each radiating element 20, 22, 24, 26 includes a support rod 28, 30 positioned within a frame of the radiating elements 20, 22, 24, 26. The radiating elements 20, 22, 24, 26 are made from a heavy gauge stainless steel.

In another exemplary embodiment of the present invention, the radiating elements 20, 22, 24, 26 are made from structural steel that is subjected to a hot-dip galvanization process to provide maximum resistance to corrosion.

The design of the radiating elements 20, 22, 24, 26 of the present invention includes a frame with a support rod, which provides a desirably small surface area of the radiating elements 20, 22, 24, 26. Accordingly, the radiating elements 20, 22, 24, 26 of the present invention can be made susceptible to small or even minimal windload. However, it should be understood by one of ordinary skill in the art that the construction of each radiating element, in accordance with the present invention, may vary in size, shape, surface area, and thickness, and accordingly, increase or decrease in its windload bearing amount.

Each dipole pair is coupled to a dipole feed arm 32, 34. The dipole feed arms 32, 34 are coupled to a hybrid power divider 36 that feeds signal power to an antenna assembly, 14, 16. In an exemplary embodiment of the present invention, two crossed dipoles, two dipole feed arms and the hybrid divider form a modular antenna assembly that may be assembled as a separate module, prior to coupling to the mast 18.

In an exemplary embodiment of the present invention, the hybrid power divider 36 is a pressurized hybrid power divider and each antenna assembly 14, 16 is pressurized to the feed point. The hybrid power divider 36 is constructed from a heavy wall copper. In the same or another embodiment the present invention, each antenna assembly 14, 16 is pressurized with dry air or nitrogen.

In an exemplary embodiment of the present invention, a panel 21, 23 is positioned intermediate each antenna assembly 14, 16. Each panel 21, 23 is a screen that includes a grid of poles, which may be utilized, for example, by a service person as steps for climbing in between screens, when servicing the antenna 10. Each screen is made from structural steel. The screens, after fabrication are subjected to a hot-dip, galvanization process to maximize its resistance to corrosion.

In an exemplary embodiment of the present invention, a tuning assembly 38, 40 is coupled to each antenna assembly 20, 26. Each tuning assembly 38, 40 includes four tuning elements 42–46 that are coupled to a tuning base 48 or formed continuously with the tuning base 48. Each tuning assembly 38, 40 is independently assembled as a modular unit that is coupled to an antenna assembly 14, 16 via one or more coupling mechanisms, for example non-metallic screws 50, 52.

In an exemplary embodiment of the present invention, each tuning assembly 38, 40 is provided with a port 54. Each tuning element 38, 40 is smaller than a radiating element 20, 22, 24, 26, for example, about half the size of a radiating element 20, 22, 24, 26. Each tuning assembly 38, 40 is utilized to match the impedance of the radiating elements 20, 22, 24, 26 to the impedance of, for example, the dipole feed lines 32, 34 that feed the signal power received at the hybrid divider 36 to each dipole, i.e., pair of radiating elements 20, 22, 24, 26. It is known in the art that impedance matching facilitates efficiency in the transmitting of power from one component in an antenna system to another component in an antenna system. Accordingly, each tuning assembly 38, 40 minimizes signal power loss during the transmission of the signal power from the dipole feed lines 32, 34 to the radiating elements 20, 22, 24, 26.

In an exemplary embodiment of the present invention, a radome 56 is utilized to protect the point, where the signal is transmitted from the dipole feed lines 32, 24 to the radiating elements 20, 22, 24, 26, from environmental conditions, such as ice, snow, rain and other forms of moisture that could interfere with the transmission of signal power from the dipole feed lines 32, 34 to the radiating elements 20, 22, 24, 26.

In an exemplary embodiment of the present invention, each radome 56 is made from a non-metallic material. For example, each radome 56 can be a non-pressurized ABS radome. Each tuning assembly 38, 40 can be designed to couple to or fit over each radome 56.

In an exemplary embodiment of the present invention, the mast 18 is constructed from a heavy wall large diameter pipe made from structural steel. The mast can be subjected to a hot-dip galvanization process to increase its resistance to corrosion. In an exemplary embodiment of the present invention, the mast has a diameter of twenty-four inches. However, the overall diameter and wall thickness of the mast may vary according to the antenna's application.

In an exemplary embodiment of the present invention, the mast 18 surrounds an internal feed system. A cut-out section, for example, a port opening 58 provides access to an internal feed system as described with reference to FIG. 2. Accordingly, the internal feed system can be easily serviced. In addition, components of the internal feed system can be easily removed from the mast 18 via one or more ports 58.

Figure 2:
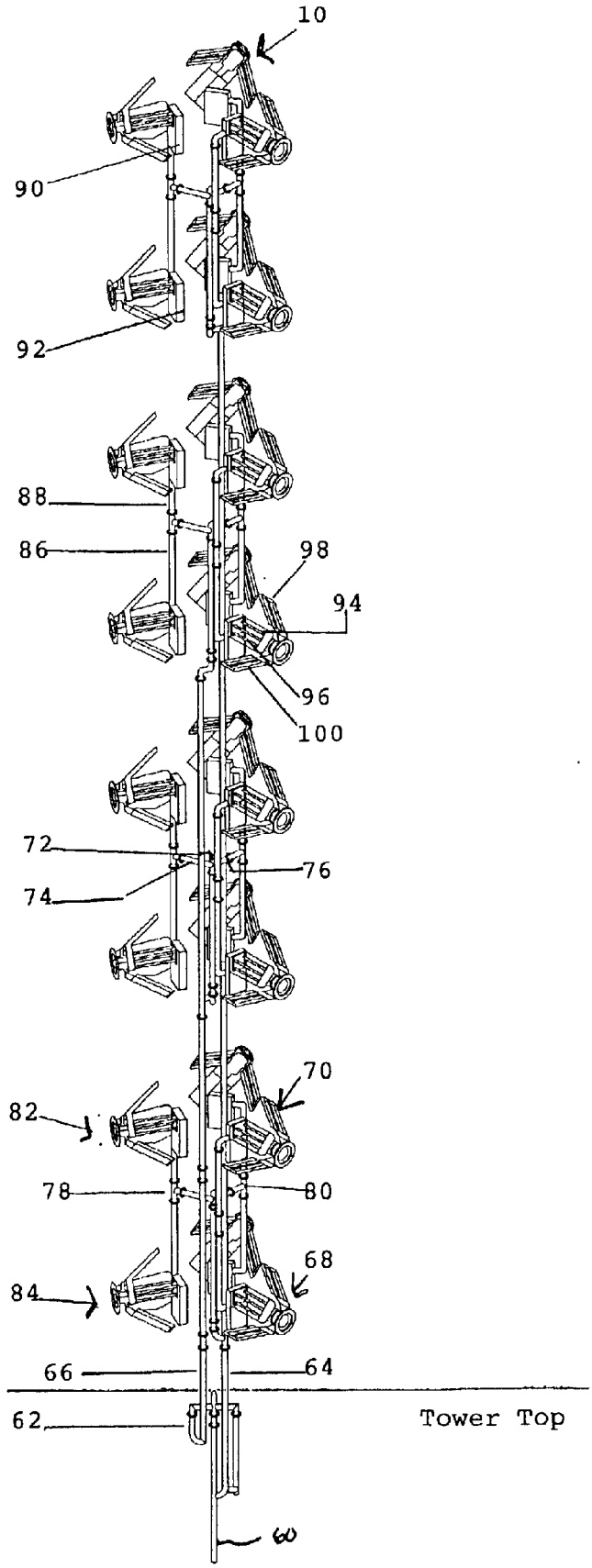
FIG. 2 is a perspective view of a feed system of an eight-bay antenna in accordance with the present invention.

Referring now particularly to FIG. 2, in an exemplary embodiment of the present invention, a coaxial feed system for feeding an antenna 10, having eight bays is illustrated. The coaxial feed system includes an internal and an external feed system. The components of the internal and external feed system are made from a rigid coaxial feed line, which is preferably made, for example from copper.

The internal feed system includes an input feed line 60 that receives signal power, from for example, a transmitter. The input feed line 60 is coupled to a main power divider 62 that divides the power among main output lines 64, 66.

In an exemplary embodiment of the present invention, the main power divider 62 is a four-way power divider that serves to divide the signal power received by the input feed line 60 between four main output lines, for example, main output lines 64, 66. The main power divider 62 divides the signal power equally among four main output lines, 64, 66, and in such a manner that each portion of signal power that is supplied to each main output line 64, 66 is suitably phased with the other portions of the signal power. The main power divider 62 is located below the top of an antenna tower. The below tower top location of the main power divider 62 provides for easy installation, inspection and trouble shooting. The below tower top location also protects the main power divider protection from falling ice.

In an exemplary embodiment of the present invention, each rigid main output line 64, 66 serves up to two bays of the antenna 10. Thus, for the antenna 10 having eight bays such as bays 68, 70, four main output lines, such as main output lines 64, 66 are utilized.

In an exemplary embodiment of the present invention, there are two input feed lines 60 and two main power dividers 62. However, the number of input feed lines 60, the number of main power dividers 62, the number of ways that each main power divider 62 splits the signal power, the number of input feed lines 60, and the number of main output lines 64, 66 required may vary. In an exemplary embodiment of the present invention, 3⅛ inch or 4¹⁄₁₆ inch, rigid Electronic Industry Alliance (EIA) standard lines are utilized for the main output lines 64, 66.

In an exemplary embodiment of the present invention, each of the four main output lines 64, 66 is individually coupled to a three-way power divider 72 that is also part of the internal feed system. In an antenna 10, which has eight bays, there are four three-way power dividers, and each three-way power divider serves two bays. Each three-way power divider divides the signal power between three three-way output lines 74, 76. Each three-way output line 74, 76 is coupled to a two-way power divider 78, 80.

Accordingly, the signal power output from each of the three-way output lines 74, 76 is divided, for example, in half by a two-way power divider 78, 80, such that two antenna assemblies 82, 84 from two different antenna bays 68, 70 can be served. In an exemplary embodiment of the present invention, each three-way output line 74, 76, via a two-way power divider 78, 80, serves, for example, an upper antenna assembly 82 and a lower antenna assembly 84 via two two-way output lines 86, 88. Accordingly, a single two-way output line 86, 88 feeds each antenna assembly 82, 84 and installation of an antenna 10 in accordance with the present invention is made simpler. In an exemplary embodiment of the present invention, a two-way output line 86, 88 is a 3-⅛ inch rigid 50 ohm EIA feed line.

The two-way power dividers 78, 80 are preferably external to the mast 18, shown in FIG. 1 and part of the external feed system. Each of the two-way output lines 86, 88 is preferably connected to a hybrid power divider 90, 92 that is also part of the external feed system and two dipole feed lines 94, 96 extend from each hybrid power divider 90, 92 to deliver the signal power to the radiating elements 98, 100 of each of the antenna assemblies 82, 84. Each dipole feed line 94, 96 is also part of the external feed system, and is utilized to deliver the signal power to a pair of opposing radiating elements 98, 100.

Figure 3:
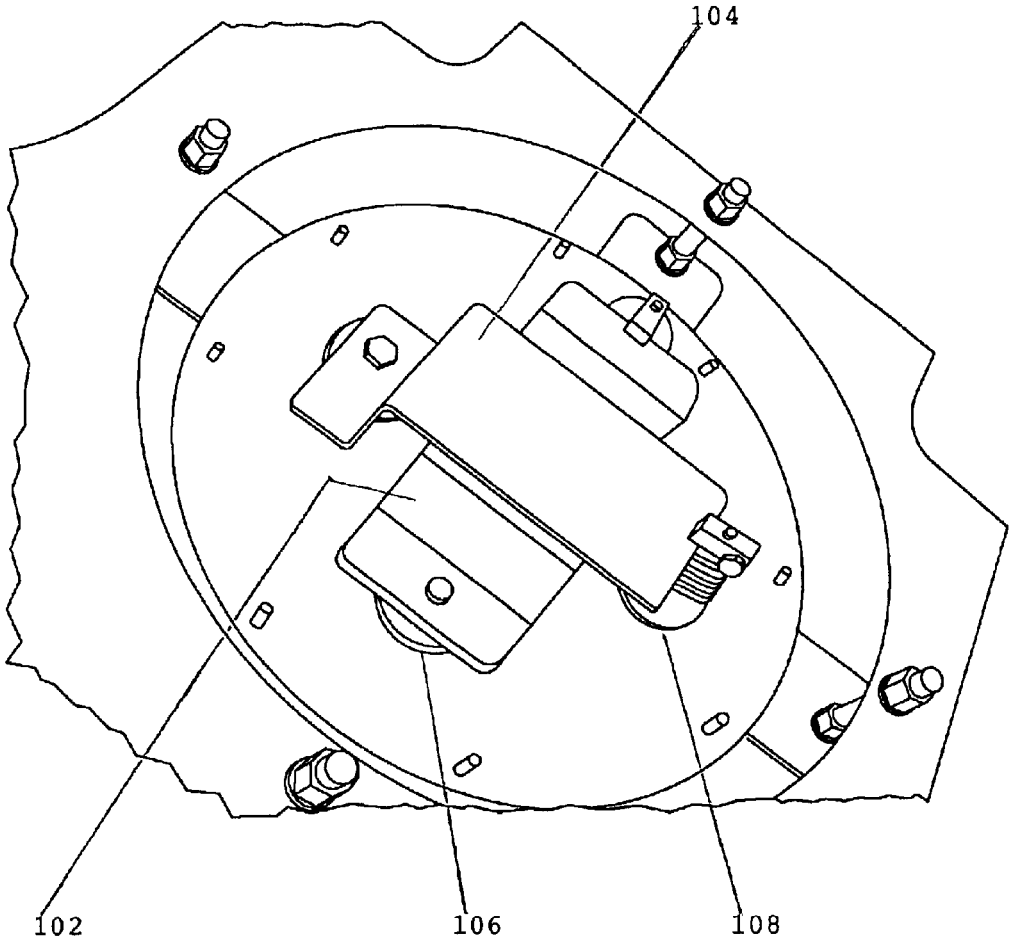
FIG. 3 is a rear elevation view of feed straps in accordance with the present invention.

FIG. 3 illustrates feed straps 102, 104 that can be used in the present invention. As shown in FIG. 3, each of two dipole feed lines 106, 108 is individually connected to one of the feed straps 102, 104. Each feed strap is positioned between each half of a dipole, and delivers each dipole half a signal that is out of phase with the opposing half by ninety degrees. The feed straps 102, 104 can feed each of the four dipole halves ninety degrees out of phase with each of the other dipole halves.

Accordingly, due to the feeding of the four radiating elements ninety degrees out of phase with each other, each antenna assembly transmits a signal that is circularly polarized. The screens, shown in FIG. 1, control the signal radiation from each of the antenna assemblies by directing and shaping the radiation pattern, such that the radiation pattern of each antenna assembly adds together with the radiation patterns of the other antenna assemblies to produce a omni-directional pattern from the sum of the individual radiation patterns of each antenna assembly.

Accordingly, an antenna in accordance with the present invention can provide full FM bandwidth capability (i.e., from 88–108 MHz.) Some embodiments of the antenna can also be susceptible to reduced windload, and provide excellent omni-directional azimuth patterns. Further, the pole mount design and flanged mast allow installation on the top of towers, as the top or bottom of an antenna stacked array or as a single antenna on one arm of a starmount platform. Additionally, the high power handling capability and low VSWR due to the impendence matching features can make antennas according to the invention useful as a master FM antenna system.

The rigid coaxial internal and external feed system independently feeds each antenna bay and thus, provides increased reliability. The design of the feed system also allows for continued operation in the event of an emergency, by allowing a rigid line to by-pass from, for example, a location below the tower top, and independently feed a pair of antenna bays.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna system, comprising:

a mast;

a first dipole;

a second dipole, wherein the first dipole crosses with the second dipole, and wherein the first dipole and the second dipole form a first antenna assembly that is pressurized and coupled to the mast;

a pressurized hybrid power divider coupled to the first antenna assembly; and an internal feed system positioned within the mast and coupled to the pressurized hybrid power divider.

2. The antenna system of claim 1, wherein the internal feed system comprises a rigid coaxial feed harness.

3. The antenna system of claim 1, further comprising a two-way power divider coupled to said pressurized hybrid power divider.

4. The antenna system of claim 3, wherein the internal feed system includes a three-way power divider coupled to the two-way power divider.

5. The antenna system of claim 4, further comprising a main power divider coupled to the three-way power divider.

6. The antenna system of claim 5, wherein the main power divider is positioned below a top of an antenna tower, when the antenna system is installed on the antenna tower.

7. The antenna system of claim 1, wherein the mast has a flange.

8. The antenna system of claim 1, wherein the antenna assembly is made at least partially from stainless steel.

9. The antenna system of claim 1, wherein the pressurized hybrid power divider is made at least partially from copper.

10. The antenna system of claim 1, wherein the first dipole and the second dipole comprise at least four radiating elements.

11. The antenna system of claim 1, wherein the pressurized antenna assembly and the pressurized hybrid divider form a pressurizable modular unit.

12. The antenna system of claim 1, wherein the mast comprises access ports.

13. The antenna system of claim 1, further comprising an external feed system positioned external to the mast and comprising a rigid coaxial feed harness.

14. The antenna system of claim 1, wherein said antenna assembly transmits signals in the range of 88–108 MHz.

15. The antenna system of claim 1, further comprising:

a third dipole and a fourth dipole that form a pressurized second antenna assembly; and a fifth dipole and a sixth dipole that form a third pressurized antenna assembly, wherein the first antenna assembly, the second antenna assembly, and the third antenna assembly form a first antenna bay.

16. The antenna system of claim 15, further comprising a screen, wherein the screen is positioned intermediate to the pressurized first antenna assembly and the pressurized second antenna assembly.

17. An antenna system comprising:

a first dipole half;

a second dipole half, wherein the first dipole half and the second dipole half form a first dipole;

a third dipole half;

a fourth dipole half, wherein the third dipole half and the fourth dipole half form a second dipole, and wherein the first and second dipole form a pressurized first antenna assembly;

a mast that supports the pressurized first antenna assembly; and an internal feed system having a rigid coaxial feedline positioned within the mast that feeds the pressurized first antenna assembly.

18. The antenna system of claim 17, further comprising:

a pressurized hybrid power divider that maintains a quadrature phasing between the first dipole half, the second dipole half, the third dipole half, and the fourth dipole half.

19. A method for transmitting a circularly-polarized signal, comprising;

inputting signal power into a main power divider;

transmitting the signal power from the main power divider to main output lines positioned within a pressurized mast;

transmitting the signal power from the main output lines to a three-way power divider positioned within the mast;

transmitting the signal power from the three-way power divider to a two-way power divider positioned external to the mast;

transmitting the signal power from the two-way power divider to a pressurized hybrid power divider; and transmitting the signal power from the pressurized hybrid power divider to crossed dipoles.

20. The method of claim 19, further comprising maintaining quadrature phasing between the crossed dipoles.

21. An antenna system, comprising:

means for inputting signal power into a main power divider;

means for transmitting the signal power from the main power divider to main output lines positioned within a pressurized mast;

means for transmitting the signal power from the main output lines to a three-way power divider positioned within the pressurized mast;

means for transmitting the signal power from the three-way power divider to a two-way power divider positioned external to the pressurized mast;

means for transmitting the signal power from the two-way power divider to a pressurized hybrid power divider; and means for transmitting the signal power from the pressurized hybrid power divider to crossed dipoles.

22. An antenna system, comprising:

a mast;

a first dipole;

a second dipole, wherein the first dipole crosses with the second dipole, and wherein the first dipole and the second dipole form a pressurized first antenna assembly that is coupled to the mast;

a pressurized hybrid power divider coupled to the first antenna assembly; and a rigid feed system coupled to the pressurized hybrid power divider.

* * * * *